United States Patent [19]

Tanabe et al.

[11] Patent Number: 4,968,019

[45] Date of Patent: Nov. 6, 1990

[54] SHEET FEED MECHANISM AND METHOD OF FEEDING SHEET

[75] Inventors: Kazunori Tanabe, Nagoya; Takashi Nakata, Kaizu; Susumu Kuzuya, Gifu; Hideo Yoshihara, Kasugai; Hiroaki Kimura, Nagoya; Toshiaki Sugiura, Hekinan; Morikazu Iwase, Toyohashi; Toshio Sugiura, Nagoya, all of Japan

[73] Assignee: Brother Kogyo Kabushiki Kaisha, Aichi, Japan

[21] Appl. No.: 377,137

[22] Filed: Jul. 10, 1989

[30] Foreign Application Priority Data

| | | | |
|---|---|---|---|
| Jul. 12, 1988 | [JP] | Japan | 63-175938 |
| Dec. 19, 1988 | [JP] | Japan | 63-321621 |
| Dec. 21, 1988 | [JP] | Japan | 63-324435 |
| Dec. 21, 1988 | [JP] | Japan | 63-324436 |
| Dec. 21, 1988 | [JP] | Japan | 63-324437 |

[51] Int. Cl.[5] ..... B65H 3/46

[52] U.S. Cl. ..... 271/106; 271/107

[58] Field of Search ..... 271/106, 107, 103, 105, 271/31

[56] References Cited

U.S. PATENT DOCUMENTS

| | | | |
|---|---|---|---|
| 1,648,493 | 11/1927 | McKinsey | 271/107 |
| 4,394,011 | 7/1983 | Dalton | 271/107 |
| 4,420,150 | 12/1983 | Umezawa | 271/107 X |
| 4,484,735 | 11/1984 | Goi | 271/107 X |
| 4,720,227 | 1/1988 | Eberle | 271/103 X |
| 4,767,113 | 8/1988 | Hasegawa et al. | 271/107 X |
| 4,848,764 | 7/1989 | Tajima et al. | 271/107 X |
| 4,930,763 | 6/1990 | Horii et al. | 271/31 |

*Primary Examiner*—Andres Kashikow
*Assistant Examiner*—Kenneth DeRosa
*Attorney, Agent, or Firm*—Oliff & Berridge

[57] ABSTRACT

A sheet feed mechanism has an array of suction cups into and out of contact with an uppermost one of stacked sheets in a sheet cassette. After the suction cups are held against the uppermost sheet, a vacuum is developed in the suction cups to enable the suction cups to attract the uppermost sheet. Then, the suction cups are lifted with the uppermost sheet attracted thereto, and a leading end of the attracted and lifted uppermost sheet is nipped, and the sheet is delivered into a sheet feed path. When the suction cups are lifted, they are angularly moved about an axis to cause the leading end of the attracted uppermost sheet to be obliquely separated from other stacked sheets.

15 Claims, 7 Drawing Sheets

SHEET FEED MECHANISM AND METHOD OF FEEDING SHEET

BACKGROUND OF THE INVENTION

The present invention relates to a mechanism and a method for feeding a sheet from a sheet cassette in an image recording apparatus such as a copying machine, and more particularly to a mechanism and a method of feeding a developer sheet from a sheet cassette in an image forming machine which employs a photosensitive pressure-sensitive recording sheet for carrying a latent image thereon and transferring a developed image to the developer sheet.

In general, image recording apparatuses such as the copying machines employ continuous photosensitive recording mediums such as microcapsule sheets and developer sheets used in combination with the photosensitive recording mediums. Developer sheets are stacked in a sheet cassette and usually fed one at a time from the sheet cassette by a semicircular separator roller of rubber. The separator roller and the developer sheets have different coefficients of friction. The separator roller frictionally separates the uppermost developer sheet from the lower stack of developer sheets, and delivers the separated developer sheet to a certain position.

If the developer sheets are stacked such that their reverse sides face up, then the separator roller contacts the reverse side of the uppermost developer sheet. Therefore, when the uppermost developer sheet is fed out of the sheet cassette, the color developer layer on the uppermost developer sheet rubs against the reverse side of the next developer sheet, and the developer material tends to be partly peeled off from the developer sheet. Thus, an image formed on the developer sheet may be damaged where the developer layer has been removed, resulting in poor image quality.

If the developer sheets are stacked such that their developer layers face up, then the separator roller contacts the developer layer on the uppermost developer sheet. Therefore, when the uppermost developer sheet is fed out of the sheet cassette, the separator roller tends to slip on the color layer, which may be partly peeled off. Accordingly, an image on the developer sheet may also be impaired.

Japanese Laid-Open Patent Publication No. 55-93744, for example, discloses a sheet feed mechanism which does not employ a frictional separator roller but uses a suction cup for attracting a sheet under a vacuum and feeding the attracted sheet to a certain position. According to the disclosed sheet feed mechanism, if the vacuum is too intensive, the uppermost sheet attracted by the suction cup also attracts the lower sheet or sheets under suction, and hence more than one sheet may be fed out simultaneously. The lower sheet or sheets may also be attracted to and fed with the uppermost sheet due to static electricity developed between sheets. In order to separate sheets from each other, air is ejected between them. If the vacuum is too small, the attracted sheet may drop off the suction cup due to the applied air. The sheet feed mechanism includes a support base for placing a stack of sheets which is movable up and down. Therefore, the sheet feed mechanism is relatively complex and requires a large amount of energy to be consumed. Another problem is that some stacked sheets are liable to be scattered by the applied air jet. When the support base is lowered with the uppermost sheet attracted by the suction cup, tho suction cup is moved laterally so that the leading end of the sheet can be nipped by a feed roller and a pinch roller. While the suction cup is being moved laterally, however, the attracted sheet may be dropped off from the suction cup. Therefore, the disclosed sheet feed mechanism does not operate highly reliably.

SUMMARY OF THE INVENTION

It is an object of the present invention to provide a sheet feed mechanism of a simple construction which is capable of reliably separating and feeding an uppermost one of stacked sheets without damaging and scattering them.

Another object of the present invention is to provide a method of reliably separating and feeding an uppermost one of stacked sheets without damaging and scattering them.

According to the present invention, there is provided a sheet feed mechanism comprising suction cup means movable into and out of contact with an uppermost one of stacked sheets in a sheet cassette, holding means for holding the suction cup means against the uppermost sheet, evacuating means for developing a vacuum in the section cup means to enable the suction cup means to attract the uppermost sheet, lifting means for lifting the suction cup means with the uppermost sheet attracted thereto, and nipping means for nipping a leading end of the attracted and lifted uppermost sheet and delivering the uppermost sheet into a sheet feed path.

The sheet feed mechanism further comprises means for angularly moving the suction cup means about an axis to cause the leading end of the attracted uppermost sheet to be obliquely separated from other stacked sheets.

According to the present invention, there is also provided a method of feeding a sheet from a sheet stack in a sheet cassette, comprising the steps of lowering suction cup means into a position above the sheet stack, then swinging the suction cup means about an axis in a first direction until the suction cup means is held against an uppermost sheet of the stack, evacuating the suction cup means to enable the suction cup means to attract the uppermost sheet, thereafter, swinging the suction cup means about the axis in a second direction opposite to the first direction, lifting the suction cup means away from the sheet stack, and delivering the uppermost sheet attracted to the suction cup means in the second direction.

According to the present invention, there is further provided a method of feeding a sheet from a sheet stack in a sheet cassette, comprising the steps of lowering suction cup means into a position above the sheet stack, then evacuating the suction cup means to enable the suction cup means to attract the uppermost sheet, lifting the suction cup means with the uppermost sheet attracted thereto away form the sheet stack, thereafter swinging the suction cup means about an axis in a first direction, swinging the suction cup means about the axis in a second direction opposite to the first direction, and delivering the uppermost sheet attracted to the suction cup means in the second direction.

The above and other object, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
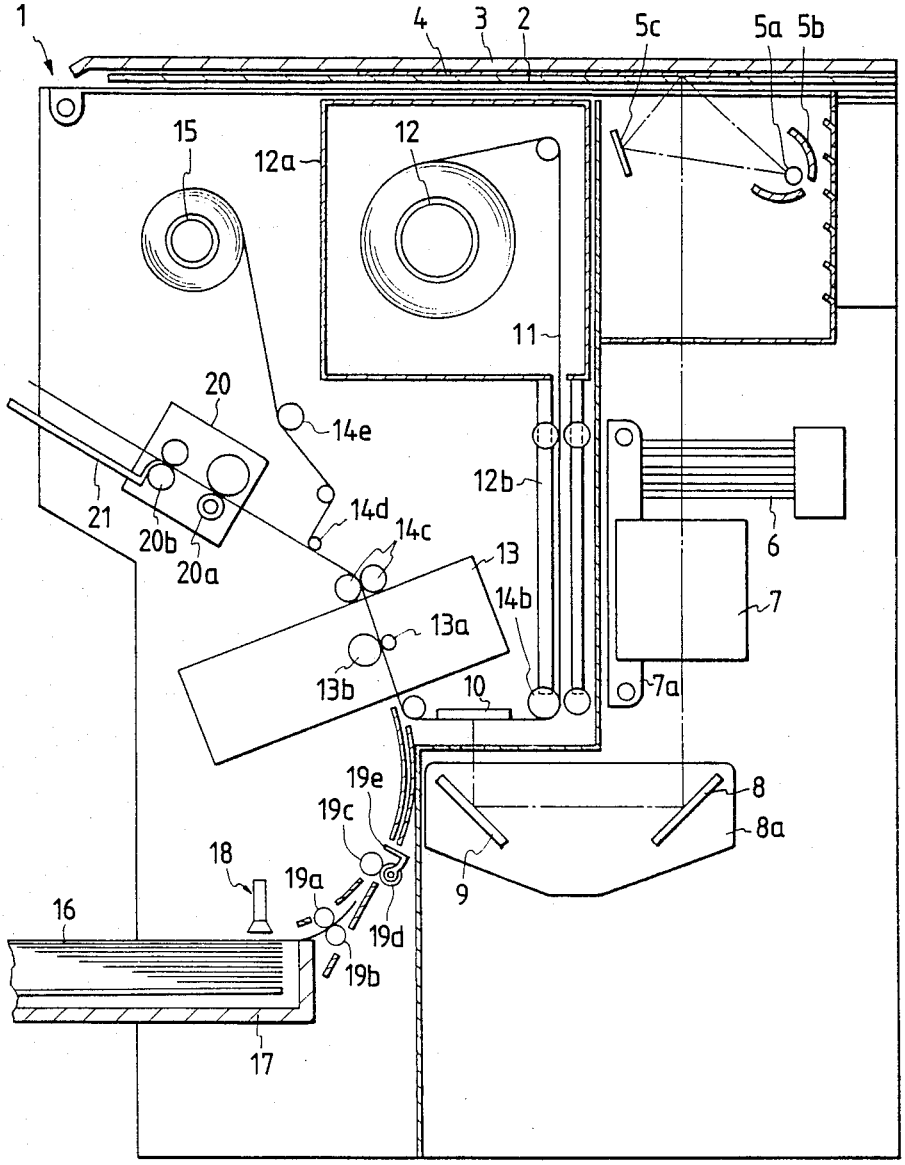
FIG. 1 is a schematic vertical cross-sectional view of a copying machine incorporating a sheet feed mechanism, according to an embodiment of the present invention.

Embodiments of the present invention will be described below with reference to FIGS. 1 through 7. Identical parts are denoted by identical reference numerals throughout views.

FIG. 1 schematically shows a copying machine incorporating a sheet feed mechanism according to an embodiment of the present invention. The illustrated copying machine, generally indicated at 1, comprises a photosensitive pressure-sensitive copying machine capable of copying full-color images. The copying machine employs a continuous photosensitive pressure-sensitive recording medium such as a photosensitive microcapsule sheet for recording a latent image thereon, and a developer sheet for receiving a developed color image from the microcapsule sheet. The photosensitive microcapsule sheet and the developer sheet are disclosed in U.S Pat. No. 4,399,209 and Japanese Laid-Open Patent Publication No. 58-88739, for example, and will not be described in detail below.

The copying machine includes an upper panel assembly having an original support stand glass 2 which is movable back and forth and an original support stand glass cover 3 that can be placed over the original support stand glass 2. An original to be copied is put on the original support stand glass 2 which is formed of light transmissive material.

The copying machine 1 also has a light source placed in an upper righthand portion thereof below the original support stand glass 2 and comprising a halogen lamp 5*a* extending in a direction normal to the direction in which the original support stand glass 2 is movable back and forth, and a semicylindrical reflecting mirror 5*b* disposed in a partially surrounding relationship to the halogen lamp 5*a*. The light source emits a linear-line light toward the lower surface of the original support stand glass 2.

When the original support stand glass 2 moves, the light emitted from the halogen lamp 5*a* continuously irradiates the entire surface of the original support stand glass 2 from the lefthand to the righthand end thereof (as viewed in FIG. 1). The light from the light source passes through the transparent original support stand glass 2, and is then reflected by the original placed on the original support stand glass 2. The original support stand glass cover 3 covers the entire upper surface of the original support stand glass 2 so that the light applied to the original support stand glass 2 will not leak out from those areas of the original support stand glass 2 which are not covered by the original.

A reflector 5*c* is positioned on the lefthand side of the light source for applying lights emitted from the halogen lamp 5*a* to the original highly efficiently. The reflector 5*b* reflects those emitted light which are not directed toward the original support stand glass 2.

The light reflected from the original on the original support stand glass 2 is directed downwardly and passes through a filter 6 and a lens 7. The filter 6 serves to pass desired wavelengths of light dependent on the sensitivity of microcapsule sheet 11 for adjusting the colors of a copied image. The lens 7 is mounted on a lens attachment 7*a* which is slightly angularly adjustable with respect to the path of the light through the filter 6 and the lens 7.

The light converged by the lens 7 is directed 180° back by two reflecting mirrors 8, 9 and then focused on the microcapsule sheet 11 held closely against the lower surface of an exposure table 10. The reflecting mirrors 8, 9 are mounted on a mirror attachment 8*a* which is slightly positionally adjustable to vary the length of the light path and the focused condition.

The microcapsule sheet 11 is of a continuous elongate length and wound around a cartridge reel 12 which is placed in a removable cartridge 12*a* positioned below the original support stand glass 2. A leading end portion of the microcapsule sheet 11 extends through many rollers and a pressure developing unit 13 toward a takeup reel 15.

More specifically, the microcapsule sheet 11 drawn out of the cartridge 12*a* from its lower end is fed and guided by a feed roller 14*a* and a guide roller 14*b*, and extends beneath the exposure table 10 into the pressure developing unit 13. The microcapsule sheet 11 which has passed through the pressure developing unit 13 is fed by a pair of feed rollers 14*c*, travels past a separator roller 14*d* and an adjustment roller 14*e*, and is then wound around the takeup reel 15. The microcapsule sheet 11 discharged from the cartridge 12*a* remains unexposed by a light-shielding cover 12*b* before the microcapsule sheet 11 reaches the exposure table 10.

The speed at which tho microcapsule sheet 11 is fed is controlled so as to be held at a constant level, and remains the same speed at which the original support stand glass 2 is moved. Therefore, a latent image can be formed successively line by line on the microcapsule sheet 11 when it moves past the exposure table 10.

A developer sheet cassette 17 storing a stack of developer sheets 16 is disposed below the pressure developing unit 13. One, at a time, of the developer sheets 16 is taken out of the cassette 17 by a sheet feed mechanism 18 which attracts the developer sheet 16 under suction. The developer sheet 16 which is taken from the cassette 17 is delivered by a feed roller 19*a* and a pinch roller 19*b*. After the leadIng end of the developer sheet 16 is aligned by rollers 19*c*, 19*d*, a resist gate 19*e*, the developer sheet 16 is fed into an inlet slot of the pressure developing unit 13.

The microcapsule sheet 11 and the developer sheet 16 are closely held against each other when they are introduced into the pressure developing unit 13. The pressure developing unit 13 includes a smaller-diameter roller 13*a* and a backup roller 13*b*. The microcapsule sheet 11 and the developer sheet 16 are sandwiched and pressed together between the smaller-diameter roller 13*a* and the backup roller 13*b*. At this time, a microcapsule layer on the microcapsule sheet 11 with the latent image formed thereon and a color developer layer on the developer sheet 16 are held against each other. Those microcapsules in the microcapsule layer which are not exposed are ruptured under pressure, and a developed image is transferred into the developer sheet 16.

The microcapsule sheet and the developer sheet 16 which have left the pressure developing unit 13 are fed by the rollers 14*c*. Then, the microcapsule sheet 11 is separated from the developer sheet 16 by the separator roller 14*d*. The microcapsule sheet 11 is directed upwardly, whereas the developer sheet 16 travels straight ahead into a thermal fixing unit 20. The thermal fixing unit comprises a heater roller 20*a* and a feed roller 20*b*. After color development on the developer sheet 16 is promoted and the color image is fixed by the heat fixing unit 20, the developer sheet 16 is discharged into a tray 21 with the developed image facing up. The separated microcapsule sheet 11 travels past the adjustment roller 14*e* and is wound around the takeup reel 15.

The sheet feed mechanism 18 will be described in greater detail with reference to FIGS. 2 and 3.

The sheet feed mechanism 18 includes a pair of suction cups 31 mounted on an angularly movable elevator arm 32 by means of an attachment plate 32*a*. The elevator arm 32 has two pivot shafts 34 (one shown in FIG. 2) rotatably supported on elevator frames 36 vertically movably mounted on machine side plates 35 (one of which is shown in FIG. 2). The pivot shafts 34 about which the suction cups 31 are angularly movable have their central axes lying on a plane which contains the suction surfaces of the suction cups 31. The pivot shafts 34 are positioned behind, or upstream of, the position there the suction cups 31 attract the developer sheet 16, with respect to the direction in which the color developer sheet 16 is fed from the cassette 17.

The suction cups 31 are positioned such that they attract the developer sheet 16 at its relatively forward portion in the direction of feed of the developer sheet 16. An uppermost sheet sensor 33 which may comprise a microswitch, for example, is mounted on the elevator arm 32 by means of an attachment plate 32*b* extending from and inclined at an angle to the attachment plate 32*a*. When the attachment plate 32*b* extends vertically, the sensor 33 and the pivot shafts 34 are disposed in a common horizontal plane.

A motor 37 is mounted on one of the frames 36, and a gear 38 rotatable by the motor 37 is also supported on the frame 36. The gear 38 is held in mesh with a swing gear 39 fixed to the pivot shaft 34. Therefore, when the motor 37 is energized, the elevator arm 32 is angularly moved about the pivot shafts 34 in the directions indicated by the arrows A, B (FIG. 3)).

Each of the frames 36 is supported by a vertical guide mechanism (not shown), and can be moved vertically in the direction indicated by the arrows C, D by a step motor 40. Shafts 41, 42 mounted on the machine side plate 35 extend through respective vertical slots 43, 44 defined in the frame 36. Gears 45, 46 fixed to the shafts 41, 42, respectively, are held in mesh with racks 47, 48 defined on edges of the slots 43, 44. A timing belt 51 is trained around pulleys 49, 50 fixed respectively to the shafts 41, 42. A helical gear 52 fixed to the end of the shaft 41 is held in mesh with a worm gear 53 fixed to the output shaft of the step motor 40.

Each of the suction cups 31 has an inner hole defined in its bottom and connected through a flexible tube 54 to an evacuating means 56 mounted on the other machine side plate. The evacuating means 55 comprises a cylinder 56, a piston 58 having an O-ring 57 and slidably fitted in the cylinder 56, intermeshing gears 59, 60, and a step motor 61. When the step motor 61 is energized, the gear 60 mounted on the output shaft of the step motor 61 causes the gear 59 to rotate about a shaft 62. A pin 63 is disposed on the gear 60 near an outer peripheral surface thereof and fitted in a slot defined in one end of a piston rod 64 joined to the piston 58. Therefore, the gear 59 causes the piston 58 to move linearly in the cylinder 56 in the direction indicated by the arrow E, thereby developing a vacuum in the cylinder 56 which is connected to the tube 54.

The cylinder 56 has an open end through which the piston rod 64 extends. The open end of the cylinder 56 is preferably directed downwardly so that dust will not be deposited in the cylinder 56 and grease for lubricating the inner surface of the cylinder 56 will not flow through the tube 54 toward the sheets 16. If the open end of the cylinder 56 is directed upwardly, then it should be closed by a cover to prevent foreign matter such as dust and dirt from entering the cylinder 56.

Figure 2:
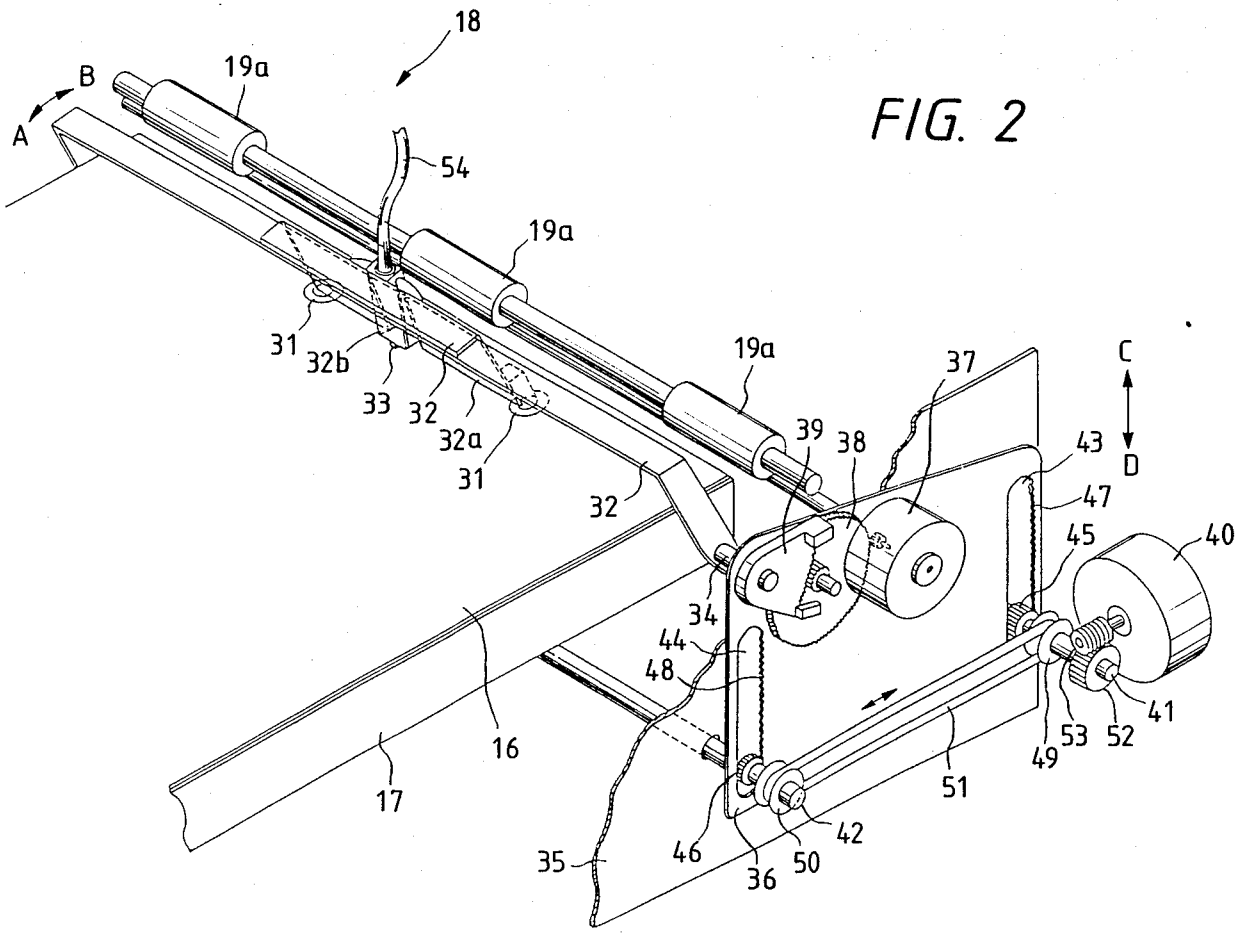
FIG. 2 is an enlarged fragmentary perspective view of the sheet feed mechanism.
Figure 3:
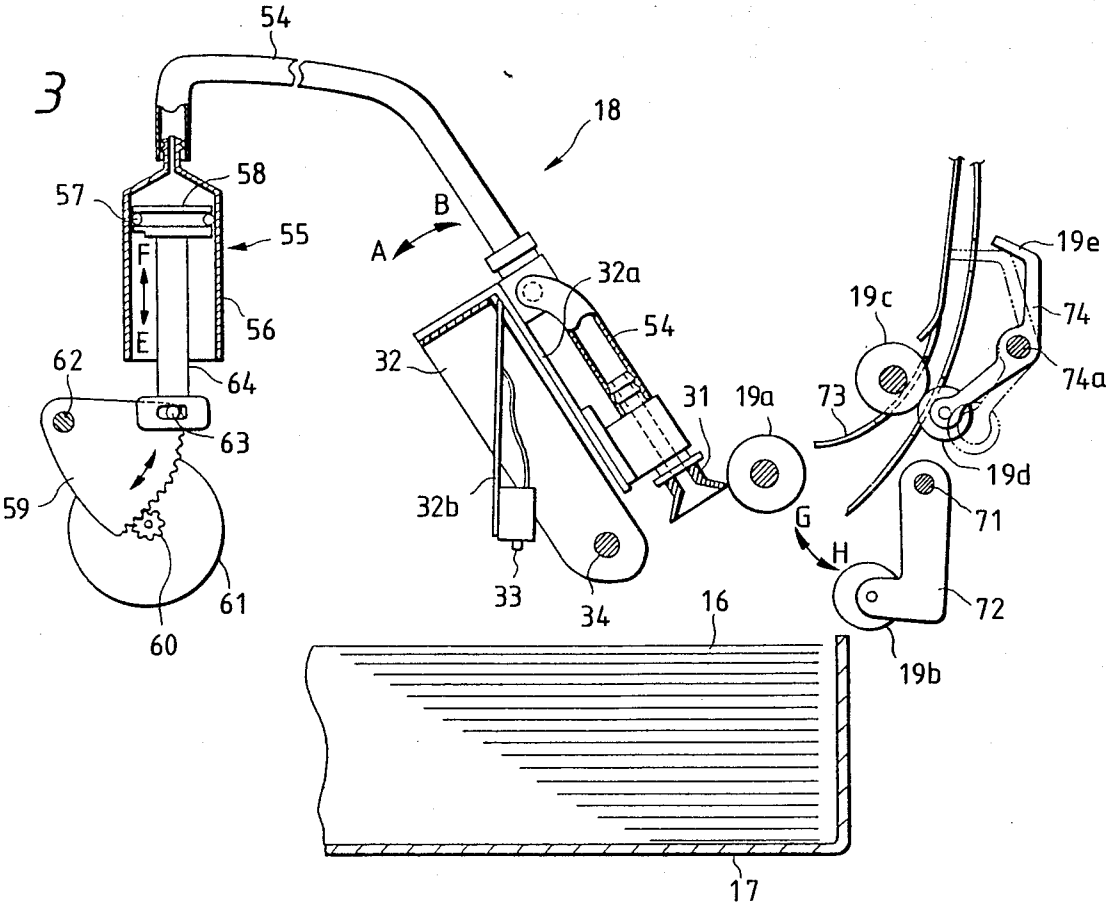
FIG. 3 is a side elevational view, partly out away, of the sheet feed mechanism.
Figure 4A:
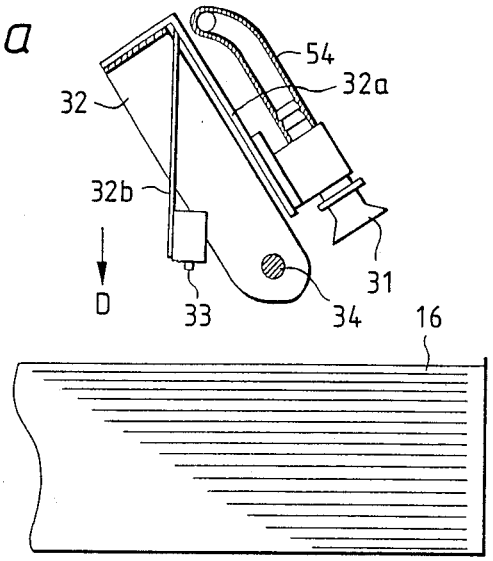
FIGS. 4(*a*) through 4(*d*) are sectional side elevational views showing a sequence of operation of the sheet feed mechanism.
Figure 4B:
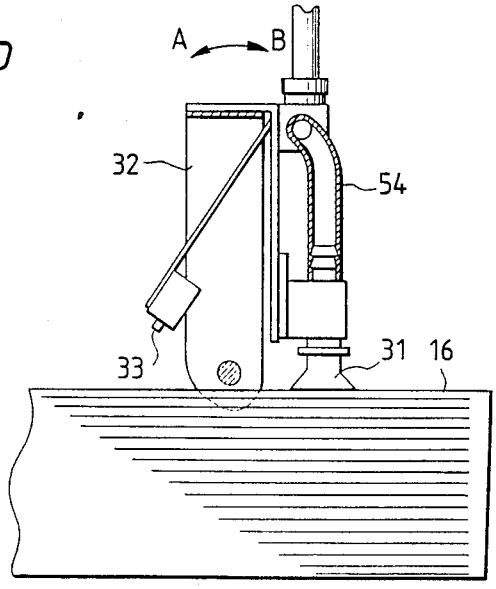
Figure 4C:
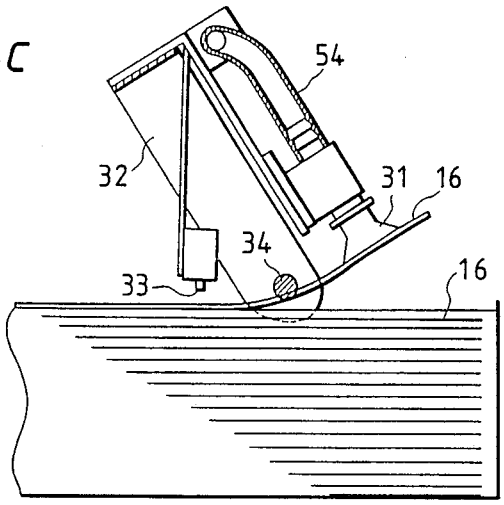
Figure 4D:
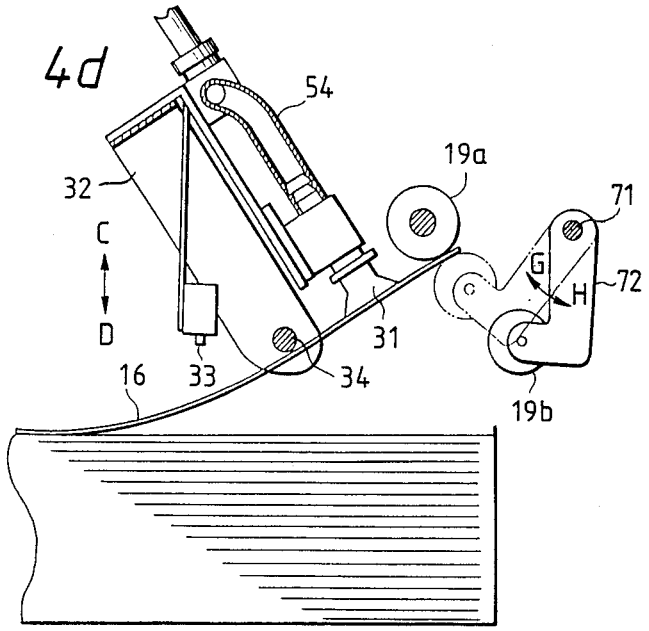

The feed roller 19*a*, which is shown as a plurality of feed rollers 19*a* in FIG. 2, is disposed upwardly of the leading ends of the developer sheets 16 stacked in the cassette 17. The pinch roller 19*b* is movable toward and away from the feed roller 19*a* and rotatably supported on the distal ends of swing arms 72 (one shown in FIG. 3) which are angularly movable about a shaft 71 in the directions indicated by the arrows G, H. The swing arms 72 are angularly moved by a drive source (not shown) each time a developer sheet 16 is to be fed out of the cassette 17, for thereby moving the pinch roller 19*b* toward and away from the feed roller 19*a*. A guide member 73 is disposed downstream of the rollers 19*a*, 19*b* with respect to the direction of feed of the developer sheets 16, the guide member 73 defining a sheet feed path. The rollers 19*c*, 19*d* and the resist gate 19*e* are also disposed downstream of the rollers 19*a*, 19*b*. The resist gate 19*e* comprises an end of a lever 74 rotatable about a shaft 74*a*. The roller 19*d* is supported on the other end of the lever 74. The roller 19*d* and the resist gate 19*e* are angularly movable alternatively between the solid-line position end the two-dot-and-dash-line position in FIG. 3.

Operation of the sheet feed mechanism 18 thus constructed will be described below with reference to FIGS. 2, 3, and 4(*a*) through 4(*d*).

It is assumed that the frames 36 are first disposed in a home position. In response to a sheet feed signal from the controller of the copying machine 1, the step motor 40 is energized, and its rotation is transmitted through the worm gear 53 and the helical gear 52 to the shaft 41 to rotate the gear 45 in the clockwise direction in FIG. 2. At the same time, the gear 46 on the shaft 42 is rotated in the clockwise direction through the pulley 49, the timing belt 51, and the pulley 50. As the gears 45, 46 are in mesh with the respective racks 47, 48, the frame 36 is moved downwardly in the direction indicated by the arrow D. Upon the downward movement of the frame 36, the attachment plate 32*b* is in its vertical position as shown in FIGS. 3 and 4(*a*), and the sensor 33 can first detect the uppermost sheet surface in the cassette 17.

When the sensor 33 detects the uppermost sheet surface, the step motor 40 is de-energized to stop the downward movement of the frame 36. Then, the step motor 37 is energized, and its rotation is transmitted to the gears 38, 39 to rotate the shafts 34 about their own axes. The suction cups 31 are then moved downwardly along an arcuate path until they are held against the uppermost color developer sheet 16 as shown in FIG. 4(*b*).

Then, the motor 61 is energized to move the piston 58 in developed in each of the suction cups 31 to enable the suction cups 31 to attract the uppermost developer sheet 16.

With the suction cups 31 attracting the uppermost developer sheet 16, the step motor 37 is reversed to turn the arm 32 through a predetermined angle about the shaft 34 in the direction indicated by the arrow A until the arm 32 assumes the position shown in FIG. 4(*c*). At this time, the arm 32 is not turned about the suction cups 31, but is turned about the shafts 34 positioned behind the suction cups 31. Therefore, tho suction cups 31 are also turned about the shafts 34. The suction cups 31 attract the uppermost developer sheet 16 under suction and lift the leading end portion of the developer sheet 16 off the next developer sheet 16. At this time, the uppermost developer sheet 16 is separated from the lower developer sheet 16 because of the stiffness of the upper developer sheet 16. Even if the vacuum developed in the suction cups 31 is relatively small in pressure, the suction cups 31 can separate the uppermost developer sheet 16 since it is simply lifted off the lower developer sheet 16 without frictional engagement therewith. If the suction cups 31 were not turned but are operated only to attract the developer sheet 16, two or more developer sheets would be fed out at the same time when an electrostatic force acting on these sheets is greater than the weight of the developer sheet 16. Since the suction cups 31 are actually turned about the shafts 34, however, two or more developer sheets are prevented from being fed out together. An experiment conducted on the sheet feed mechanism 18 indicated than the uppermost developer sheet 16 could sufficiently be separated from the lower developer sheet 16 by the suction cups 31 when the arm 32 was turned through about 30°. After the uppermost developer sheet 16 has been separated, the step motor 40 is reversed to elevate the frames 36 and hence the elevator arm 32 in the direction indicated by the arrow C up to the position shown in FIG. 4(*d*) in which the leading end of the developer sheet 16 is positioned directly below the feed roller 19*a*.

Then, the pinch roller 19*b* is swung about its own axis in the direction indicated by the arrow G to pinch or nip the leading end of the developer sheet 16 between the pinch roller 19*b* (indicated by the two-dot-and-dash lines) and the feed roller 19*a*. Thereafter, the motor 61 of the evacuating means 55 is reversed to move the piston 58 in the direction of the arrow F. The vacuum in the suction cups 31 is eliminated, and the developer sheet 16 is released from the suction cups 31.

The step motor 40 is further energized to lift the frames 36 and the arm 32 by a certain distance to avoid engagement or interference between the suction cups 31 and the developer sheet 16 as it is fed along.

Through the above operation, the uppermost one of the stacked developer sheets 16 is separated end delivered into the sheet feed path. In an initial stage of the sheet feeding operation, the roller 19*d* and the resist gate 19*e* are in the two-dot-and-dash position shown in FIG. 3, and hence the rollers 19*c*, 19*d* are spaced from each other. The developer sheet 16 is fed by the feed roller 19*a* and the pinch roller 19*b* until its leading end is engaged by the resist gate 19*e*, whereupon the leading end of the developer sheet 16 is properly aligned and corrected out of any skewed condition. Then, the lever 74 is turned to displace the roller 9*d* against the roller 19*c* and pull the resist gate 19*e* out of the sheet feed path. The developer sheet 16 is now fed along the sheet feed path toward the pressure developing unit 13.

According to a modified sequence of operation of the sheet feed mechanism 18, a first vacuum just enough to attract and separate the uppermost developer sheet 16 from the sheet stack below is developed in the suction cup 31 when the suction cups 31 are held against the uppermost developer sheet 16, as shown in FIG. 4(*b*). It was experimentally confirmed that the first vacuum should be intensive enough to draw a volume of 0.75 cc. After the uppermost developer sheet 16 has been separated as shown in FIG. 4(*c*), a second vacuum greater than the first vacuum is developed in the suction cups 31, and thereafter or simultaneously, the frames 36 and the arm 32 are elevated in the direction indicated by the arrow C is FIG. 4(*d*). The second vacuum is large enough prevent the separated developer sheet 16 from dropping down while the arm 32 is being elevated. It has experimentally indicated that the second vacuum should be intensive enough to draw a volume of 3 cc.

Figure 5:
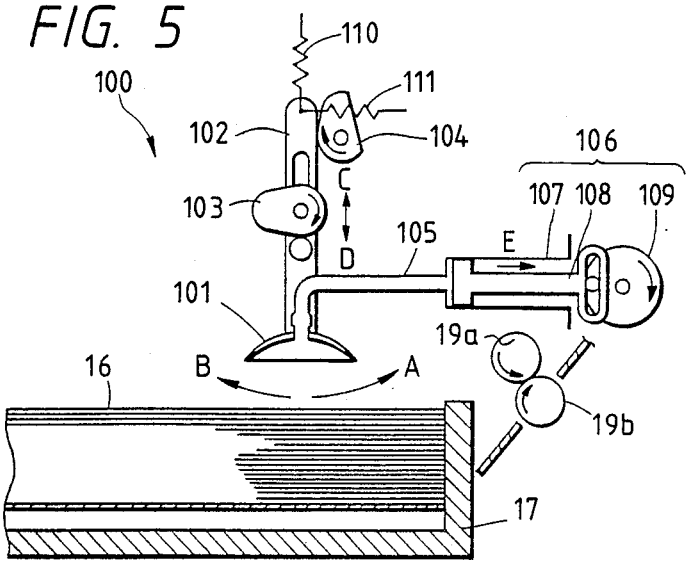
FIG. 5 is a side elevational view, partly in cross section, of a sheet feed mechanism according to another embodiment of the present invention.

FIG. 5 shows a sheet feed mechanism according to another embodiment of the present invention. The sheet feed mechanism, generally designated at 100, includes a suction cup 101 mounted on the lower end of an arm 102 suspended by a spring 110 coupled to the upper end of the arm 102. The arm 102 can be moved by a cam 103 vertically in the directions indicated by the arrows C, D against the bias of the spring 110. The arm 102 can also be angularly moved by a cam 104 back and forth in the directions indicated by the arrows A, B against the bias of a spring 111 also connected to the upper end of the arm 102. An evacuating means 106 is connected through a tube 105 to an inner hole defined in the bottom of the suction cup 101. The evacuating means 106 comprises a cylinder 107, a piston 108 slidably fitted in the cylinder 107, and a crank 109 operatively coupled to the piston rod of the piston 108. When the crank 109 is rotated, the piston 108 is moved in the cylinder 107 in the direction indicated by the arrow E to develop a vacuum in the suction cup 101. The cam 103, the cam 104, and the crank 109 are mechanically coupled to each other so that they will operate in synchronism with each other with predetermined timing.

FIGS. 6(*a*) through 6(*e*) illustrate the manner in which the sheet feed mechanism operates. The cam 103 is first rotated to lower the arm 102 in the direction of the arrow D to bring the suction cup 101 into contact with the uppermost developer sheet 16 in the cassette 17 as shown in FIG. 6(*a*). Then, the crank 109 is rotated to move the piston 108 in the direction of the arrow E thereby developing a vacuum in the cylinder 107 and hence the suction cup 101. The uppermost developer sheet 16 is therefore attracted by the suction cup 101 under the vacuum in the suction cup 101 (see FIG. 3 (*b*). With the uppermost developer sheet 16 attracted to the suction cup 101, the arm 102 is elevated by the cam 103 in the direction of the arrow C. At this time, the uppermost developer sheet 101 only or the uppermost developer sheet 16 and one or more lower developer sheets 16 are lifted up as shown in FIG. 6(*c*). Then, the arm 102 is turned by the cam 104 in the direction of the arrow B. Since the developer sheets 16 are positionally limited horizontally by the cassette 17, the uppermost developer sheet 16 attracted by the suction cup 101 is flexed, creating a gap between itself and any lower developer sheet or sheets which may have been lifted with the uppermost developer sheet 16. Any such lower developer sheet or sheets are therefore separated from the uppermost developer sheet 16 as shown in FIG. 6(*d*). Finally, the arm 102 is swung by the cam 104 in the direction of the arrow A to deliver the uppermost developer sheet 16 toward the rollers 10*a*, 19*b* as shown in FIG. 6(*e*). The sheet feed mechanism 100 is operated in the above cycle each time a sheet feed signal is supplied from the control unit of the copying machine shown in FIG. 1.

Figure 7:
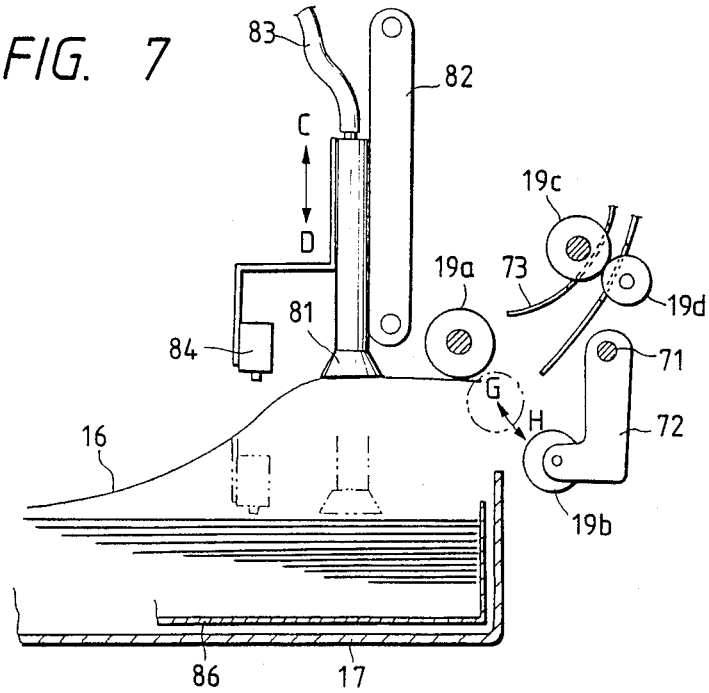
FIG. 7 is a side elevational view, partly in cross section, of a sheet feed mechanism according to still another embodiment of the present invention.
Figure 6A:
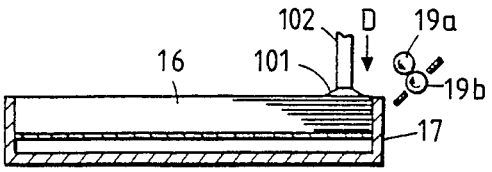
FIGS. 6(*a*) through 6(*e*) are side elevational views showing a sequence of operation of the sheet feed mechanism shown in FIG. 5.
Figure 6B:
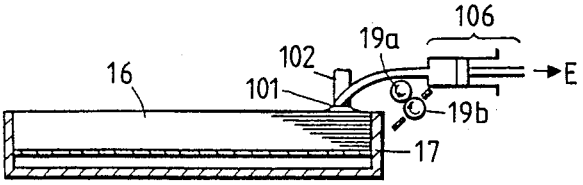
Figure 6C:
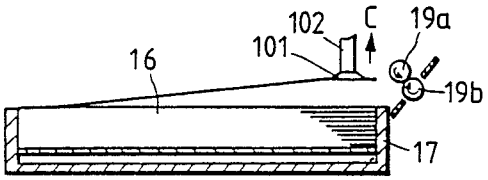
Figure 6D:
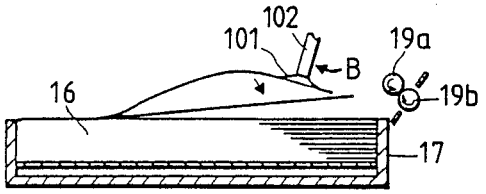
Figure 6E:
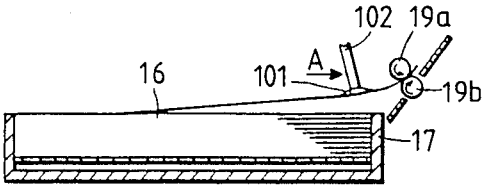

A sheet feed mechanism 80 according to still another embodiment of the present invention will be described below with reference to FIG. 7.

The sheet feed mechanism 80 includes an array of suction cups (one shown) 81 mounted on a lifting/lowering device 82 which is vertically movable by a drive source (not shown). Each of the suction cups 81 is connected through a tube 83 to an evacuating means (not shown in FIG. 7) which may be similar to the evacuating moans shown in FIG. 3 or 5. An uppermost sheet sensor 84 which may comprise a microswitch, for example, is mounted on the suction cup 81 by an arm 85. The suction cup 81 is positioned so that it attracts a leading end portion of the uppermost developer sheet 16. The stacked developer sheet 16 are placed on a sheet support 86 disposed in the cassette 17.

In operation, the lifting/lowering device 82 is operated to lower the suction cups 81 in the direction indicated by the arrow D until the sensor 84 detects the upper surface of the uppermost developer sheet 16. Then, the lifting/lowering device 82 is shut off to stop the downward movement of the suction cups 81 which are now held against the upper surface of the uppermost developer sheet 16. Then, the evacuating means is actuated to develop a vacuum in the suction cups 81 to attract the uppermost developer sheet 16.

Then, the lifting/lowering device 82 is operated again to lift the suction cups 81 up to the position in which the leading end of the attracted developer sheet 16 is positioned directly beneath the feed roller 19*a*. Then, the pinch roller 19*b* is moved toward the feed roller 19*a* in the direction of the arrow G to nip the leading end of the developer sheet 16 between the rollers 19*a*, 19*b*. Thereafter, the evacuating means is inactivated to release the developer sheet 16 from the suction cups 81. The developer sheet 16 is then fed along sheet feed path by the feed roller 19*a*.

The sheet feed mechanism according to the present invention can be incorporated in any of various other image forming machines which employ other types of recording paper than the illustrated developer sheets 16.

Although certain preferred embodiments have been shown and described, it should be understood that many changes and modifications may be made therein without departing from the scope of the appended claims.

What is claimed is:

1. A sheet feed mechanism for feeding an uppermost one of stacked sheets in a sheet cassette toward a sheet feed path, the sheet having a leading end, the sheet feed mechanism comprising:

suction cup means movable into and out of contact with the uppermost sheet;

sensor means for detecting the uppermost sheet;

first moving means for moving the suction cup means in a one direction toward and away from the uppermost sheet, movement of the moving means for moving the suction cup means toward the uppermost sheet being stopped upon detection of the uppermost sheet by the sensor means;

evacuating means for developing a vacuum in said suction cup means to enable the suction cup means to attract said uppermost sheet for lifting the sheet;

second moving means for moving the suction cup means in a second direction with the uppermost sheet attracted thereto; and nipping means for nipping the leading end of the attracted and lifted uppermost sheet and delivering the uppermost sheet into the sheet feed path.

2. A sheet feed mechanism according to claim 1, wherein said suction cup means comprises an array of suction cups positioned near the leading ends of the stacked sheets.

3. A sheet feed mechanism according to claim 1, wherein said second moving means comprises means for angularly moving said suction cup means about an axis to cause the leading end of the attracted uppermost sheet to be obliquely separated from other stacked sheets.

4. A sheet feed mechanism according to claim 3, wherein said means for angularly moving comprises a shaft, an arm angularly movably supported on the shaft having said axis, said suction cup means being supported on said arm, and a first actuator for angularly moving said arm about said shaft.

5. A sheet feed mechanism according to claim 4, wherein said first moving means comprises a frame vertically movable with respect to said sheet cassette for supporting the suction cup means through the shaft, and a second actuator for moving the frame in the vertical direction.

6. A sheet feed mechanism according to claim 1, further comprising swinging means for swinging said suction cup means with said uppermost sheet attracted thereto above said sheet cassette before said uppermost sheet is nipped.

7. A sheet feed mechanism according to claim 6, wherein said swinging means comprises means for swinging said suction cup means in a direction away from said nipping means and then in a direction toward said nipping means.

8. A method of feeding a sheet from a sheet stack in a sheet cassette, comprising the steps of:

lowering suction cup means into a position above the sheet stack;

swinging the suction cup means about an axis in a first direction until the suction cup means is held against an uppermost sheet of the sheet stack;

evacuating the suction cup means to enable the suction cup means to attract the uppermost sheet;

swinging the suction cup means about said axis in a second direction opposite to said first direction and separating the upper most sheet from other sheet without vertical lifting motion of the suction cup means;

lifting the suction cup means with the uppermost sheet attracted thereto away from said sheet stack; and delivering the uppermost sheet attracted to said suction cup means in said second direction.

9. A method according to claim 8, further comprising the steps of;

nipping a leading end of said uppermost sheet delivered in said second direction; and feeding the nipped uppermost sheet along a sheet feed path.

10. A method according to claim 8, wherein said evacuating step comprises the steps of applying a first vacuum to the suction cup means to attract the uppermost sheet, and thereafter applying a second vacuum to the suction cup means, the second vacuum being more intensive than said first vacuum to keep the attraction of the uppermost sheet to the suction cup means, and said second vacuum application step being carried out prior to said lifting step.

11. A method according to claim 8, wherein said evacuating step comprises the steps of applying the first vacuum to the suction cup means to attract the uppermost sheet, and thereafter applying a second vacuum to the suction cup means, the second vacuum being more intensive than said first vacuum to keep the attraction of the uppermost sheet to the suction cup means, the second vacuum applying step being carried out during said lifting step.

12. A method of feeding a sheet from a sheet stack in a sheet cassette, comprising the steps of:

lowering suction cup means into a position above the sheet stack;

detecting the uppermost sheet by sensor means and stopping the lowering motion of the suction cup means upon the detection;

evacuating the suction cup means to enable the suction cup means to attract the uppermost sheet;

lifting the suction cup means with the uppermost sheet attracted thereto away from said sheet stack;

swinging the suction cup means about said axis in a first direction;

swinging the suction cup means about said axis in a second direction opposite to said first direction; and delivering the uppermost sheet attracted to said suction cup means in said second direction.

13. A method according to claim 12, further comprising the steps of:

nipping a leading end of said uppermost sheet delivered in said second direction; and feeding the nipped uppermost sheet along a sheet feed path.

14. A method according to claim 12, wherein said evacuating step comprises the steps of applying a first vacuum to the suction cup means to attract the uppermost sheet, and thereafter applying a second vacuum to the suction cup means, the second vacuum being more intensive than said first vacuum to keep the attraction of the uppermost sheet to the suction cup means, the second vacuum application step being carried out prior to the lifting step.

15. A method according to claim 12, wherein said evacuating step comprises the steps of applying a first vacuum to the suction cup means to attract the uppermost sheet, and thereafter applying a second vacuum to the suction cup means, the second vacuum being more intensive than said first vacuum to keep the attraction of the uppermost sheet to the suction cup means, the second vacuum applying steps being carried out during said lifting step.

* * * * *